US005319189A

United States Patent [19]

Beauvais et al.

[11] Patent Number: 5,319,189

[45] Date of Patent: Jun. 7, 1994

[54] X-RAY IMAGE INTENSIFIER TUBE HAVING A PHOTOCATHODE AND A SCINTILLATOR SCREEN POSITIONED ON A MICROCHANNEL ARRAY

[75] Inventors: Yves Beauvais, St Egreve; Paul de Groot, St Ismier, both of France

[73] Assignee: Thomson Tubes Electroniques, Velizy, France

[21] Appl. No.: 21,451

[22] Filed: Feb. 23, 1993

[30] Foreign Application Priority Data

Mar. 6, 1992 [FR] France ..... 92 02721

[51] Int. Cl.[5] ..... H01J 40/14

[52] U.S. Cl. ..... 250/214 VT; 313/103 CM

[58] Field of Search ..... 250/214 VT, 207; 313/528, 526, 527, 542, 543, 103 CM, 105 CM

[56] References Cited

U.S. PATENT DOCUMENTS 3,497,759 2/1970 Manley .
4,489,251 12/1984 Beauvais .
4,691,099 9/1987 Johnson .
4,749,903 6/1988 Munier et al. .
4,751,423 6/1988 Munter et al. .
4,829,355 5/1989 Munier et al. .
4,855,589 8/1989 Enck et al. ..... 250/214 VT
4,943,254 7/1990 Vieux et al. .
4,960,608 10/1990 Vieux et al. .
4,980,561 12/1990 Vieux et al. .
4,985,633 1/1991 Vieux et al. .
5,083,017 1/1992 Anno et al. ..... 250/214 VT
5,159,231 10/1992 Feller et al. ..... 250/207
5,177,350 1/1993 Beauvais et al. .

FOREIGN PATENT DOCUMENTS 3704716 8/1988 Fed. Rep. of Germany . .

*Primary Examiner*—David C. Nelms
*Attorney, Agent, or Firm*—Oblon, Spivak, McClelland, Maier & Neustadt

[57] ABSTRACT

An X-ray image intensifier tube includes a scintillator screen for converting ionizing radiation into light radiation or near-visible radiation, a microchannel array for achieving electron multiplication, and a photoelectrode positioned directly on an input face of the microchannel array. The input face of the microchannel array is coated with an electrically conductive layer which directly contacts the photocathode. The present design eliminates strict spacing requirements between the photocathode and the microchannel array and allows the photocathode and the microchannel array to operate at a single potential rather than requiring separate potentials. The requirement of a separate support for the scintillator screen is also obviated since the scintillator screen is formed on the input face of the microchannel array.

8 Claims, 4 Drawing Sheets

X-RAY IMAGE INTENSIFIER TUBE HAVING A PHOTOCATHODE AND A SCINTILLATOR SCREEN POSITIONED ON A MICROCHANNEL ARRAY

BACKGROUND OF THE INVENTION

1. Field of the Invention

The invention relates to image intensifier tubes of the type wherein, firstly, an incident ionizing radiation is converted into photons in the visible or near-visible range and, secondly, an array comprising microchannels is used to achieve a gain in electrons.

2. Description of the Prior Art

Image intensifier tubes such as these are commonly used in the fields of radiology, and especially in X-ray diagnosis, where they are called X-ray or radiological image intensifier tubes (or also "IIR" tubes).

The principle of a radiological or X-ray image intensifier tube is well known. It is illustrated schematically in FIG. 1, by a sectional view of an X-ray image intensifier tube 1.

The X-ray image intensifier tube 1 comprises a vacuum-tight chamber, constituted by a central body 2 with a shape generated by revolution positioned about a longitudinal axis 3. The body 2 is closed at one end by an input window 4 and at the other end by an output port 5.

Incident X-rays penetrate the X-ray image intensifier tube through the input window 4 which, for this purpose, should be as transparent as possible to these rays: the window 4 is generally constituted by a thin metal foil of aluminium or tantalum or glass etc.). An appropriate shape and appropriate mechanical characteristics give the window 4 mechanical resistance that is sufficient to withstand the atmospheric pressure exerted from the exterior to the interior of the tube.

The X-rays then encounter a set called a primary screen 15 which converts the incident X-radiation into electrons that are sent out into the vacuum from the point at which this radiation is absorbed. The primary screen is generally constituted by a "sandwich" which successively comprises: a support 6 that is transparent to X-rays, a layer 7 of scintillating material that converts the X-ray radiation into radiation of lower energy, generally in the form of visible light, and a photocathode 8, deposited on the scintillator 7, that sends electrons out into the vacuum under the effect of the radiation emitted by the scintillator.

The scintillator support 6 should be transparent to the X-rays: it is generally constituted by a thin sheet of metal or silica-based glass, etc.

The scintillator 7 is often constituted by layer of caesium iodide having a thickness of the order of 0.2 to 0.8 mm.

The photocathode 8 is formed by a layer of a photoemissive material generally having a very small thickness (often smaller than one micrometer).

The X-ray image intensifier tube 1 further includes a set or system of electrodes 10 set to potentials (not shown) suited to the accelerating and focusing of all the electrons emitted by a same point of the photocathode 8 on a homologous point of a luminescent screen 11 located on the output port 5 side. This system of electrodes is called the electronic optical system of the X-ray image intensifier tube 1.

The luminescent screen 11 is formed by a layer deposited on a transparent support 12, located inside the tube and behind the output port 5. It is thus possible, through the output port, to observe the converted visible image of the X-ray image which has been projected on the primary screen 15 through the input window 4 of the tube.

In an X-ray image intensifier such as this each incident X photon of primary energy ranging from 30 to 100 kV, absorbed in the scintillator 7, typically gives rise to several thousands of light photons and, thereby, to the emission of several hundreds of electrons into the vacuum, the quantum yield of the photocathodes 8 generally ranging from 10% to 20%.

Each of these electrons, accelerated at a voltage of 10 to 30 kV, in turn prompts the sending out of several hundreds of light photons in bombarding the luminescent screen. Each X-ray photon absorbed by the primary screen 15 is thus converted into a number of light photons close to 10,000, emitted by the luminescent screen 11.

Furthermore, the electronic optical system of the tube generally concentrates the output image on a far smaller format than that of the input image, typically a format equal to 1/10 to 1/5. This is accompanied by a major gain in luminance for this output image. The reduction of the image also means that the 1 mm details on the primary screen are reduced to about 1/10 mm on the luminescent screen, and that the image resolution required at the level of the luminescent screen is thus far greater than that detected at the primary screen.

The photon gain, and the gain in luminance provided by the reduction, make it possible, with radiological doses that can be borne by the patient, to obtain an output image that is luminous enough to be observed and recorded by means of a cinema camera or a television camera, in constituting radioscopic systems that work in real time.

In second and third generation light image intensifier tubes (image intensifiers in which the incident radiation is in the form of visible light and which therefore comprise no scintillator), there are known ways of adding an array of microchannels in order to further increase the electron gain. However, in X-ray image intensifier tubes such as those shown in FIG. 1, the photon gain is considered to be sufficient in practically every application, and it is generally not deemed to be necessary to increase it by adding a microchannel array, although assemblies such as these have already been proposed.

However, the use of a microchannel array in X-ray image intensifier tubes to replace the electronic optical system is considered to be likely to show great advantages such as, for example, great reduction in thickness, namely in the distance between the input window and the output port; uniform resolution on the entire image field (even for large-sized images); the possibility of making it far easier to obtain square or rectangular formats that are better suited to the formats of usual images or of television screens.

X-ray image intensifier tubes using a microchannel array instead of the electronic optical system are often called X-ray image intensifier tubes with dual proximity focusing. Tubes such as these are described notably in I.C.P. Millar et al., "Channel Electron Multiplier Plates in X-Ray Image Intensification", in *Advances in Electronics and Electron Physics*, Vol. 33, Academic Press, 1972. In the X-ray image intensifier tube described in this publication, the primary screen is plane. It is stretched in parallel to and at a small distance from the input face of the microchannel array, while the luminescent screen is placed in parallel to the output face of the array, and at a small distance from said array. To prevent the dispersal of the electrons, firstly between the photocathode and the input of the array and, secondly, between the output of the array and the luminescent screen, from causing deterioration in the resolution, very small distances, typically of less than 1 millimeter, have to be maintained between the electrodes.

FIG. 2 gives a schematic view of an X-ray image intensifier tube such as this, of a type similar to the one described in the above-mentioned publication.

As in the example of FIG. 1, the X-ray image intensifier tube 20 comprises a tube body 2 positioned about a longitudinal axis 3. The body 2 is closed at one end by an input window 4 and at the other end by an output port 5.

The incident X-rays penetrate the tube 20 by the input window 4 and then encounter a primary screen 21.

Unlike in the primary screen 15 of FIG. 1, the primary screen 21 of this version is plane. It has a scintillator support 22, a scintillator 23 and a photocathode 24 which may be of a same nature and which fulfil the same functions as the support, the scintillator and the photocathode shown in FIG. 1.

The electrons (not shown) emitted by the photocathode 24 are directed by an electrical field towards the input face 26 of a microchannel array 25. To this effect, a first biasing potential and a second biasing potential V1, V2 are applied respectively t the photocathode 24 and to the input face 26, the second potential V2 being more positive than the first potential V1.

The array of microchannel array 25 is an assembly of a multitude of small parallel channels or microchannels 27 separated by partitions 28, and assembled in the form of a rigid plate. Each primary electron (sent out by the photocathode) that penetrates a microchannel 27 is multiplied by a phenomenon of secondary emission in cascade on the walls of the microchannel, so that the electron current at the output of the array can be more than a thousand times greater than the electron current at input. The diameter d1 of the microchannels may range from 10 to 100 micrometers. The microchannels 27 are inclined with respect to the normal to the plane of the array so that electrons emitted by the photocathode 24 in parallel to this normal cannot emerge from a microchannel without having given rise to a phenomenon of secondary emission. In order to reduce the number of electrons that strike the input face 26 of the array 25 outside the microchannels, it is the usual practice to make a widened or flared portion 30 at the entrance to these channels and hence to reduce the thickness of the partition walls 28. The thickness E of the plate that forms the microchannel array 25 is typically between 1 and 5 mm. The electronic gain of the array may be adjusted over a wide range of values, for example between 1 and 5000, as a function of the voltage developed between the input face 26 and an output face 31 of this array 25, namely an output face 31 to which a third biasing potential V3 is applied.

The input face 26 and the output face 31 are each covered with a metallization layer, M1, M2 respectively (represented in FIG. 2 in dark lines) through which the potentials V2, V3 are distributed over the input and output faces. Naturally, these metallizations M1, M2 should not block the microchannels 27. It must be noted that it is common practice to deposit the metallization layers M1, M2 on the walls of the microchannels 27 at the ends of these microchannels, i.e. at the input and at the output of these microchannels. Generally, the metallization layers M1,M2 are deposited on the input and output faces 26, 31 of the microchannel array by a method of vacuum evaporation of a conductive material (such as, for example, chromium, nickel-chromium, Iconel etc.,) by Joule effect in using, most often, an electron gun to sublimate the metal to be evaporated.

This technique is a standard one. To limit the penetration of the metal into the channels 27, the evaporation is done at a glancing incidence ("slantwise").

Furthermore, the microchannel array is supported, during the evaporation, on a system of planet wheels which make it possible, by continuous rotation, to expose the surface of the array to the metal flow in every direction while, at the same time, preserving the glancing incidence. The penetration of the metal into the channels 27 is thus uniform, for each channel and for all the channels.

The electrons at output of the array of microchannels are accelerated and focused by an electrical field, on a luminescent screen (35) positioned so as to be facing the array, parallel to this array, and at a distance D of the order of 1 to 5 mm. The luminescent screen 35 has dimensions substantially equal to those of the primary screen. It locally emits a quantity of light proportional to the incident electron current, and it therefore restores a visible and intensified image of the X-ray image projected on the scintillator, through the input window of the tube. The luminescent screen 35 is a layer with a thickness of several micrometers, constituted by grains of luminophor material, and it may be deposited on the output port 5. The face of the luminescent screen 35, pointed towards the array 25 of microchannels, is coated with a very thin metal layer 36, made of aluminium for example. This metallization enables the electrical biasing of the screen (by the application of a fourth potential V4 that is more positive than the third potential V3) and acts as a reflector for the light reflected rearwards by this screen.

The primary screen 21 and the array 25 of microchannels are fixedly joined to the body 2 of the tube, for example by means of lugs 29 sealed to this body. To these lugs, there are furthermore applied the biasing potentials V1, V2, V3. The primary screen 21 and the slab 25 are thus fixed so as to be electrically insulated from each other while, at the same time, being separated by a relatively small distance D1 of the order of some tens of millimeters (it must be noted that, for greater clarity, the figures have not been drawn to scale).

A structure of a X-ray image intensifier tube such as this is difficult to manufacture, especially for large-sized images. It is indeed difficult to make a perfectly plane primary screen and to maintain it in a position parallel to the microchannel array, at a very small, uniform distance. However, this is necessary to limit the angular dispersal of the electrons (an effect which reduces the spatial resolution) and to obtain efficient resolution of the image on the entire field.

Another difficulty arises out of the fact that the scintillator 23 and its support 22 do not have the same expansion coefficients: they are both constituted by thin layers that tend to get deformed, and lead to a deformation of the photocathode and hence to a local modification of the distance between this photocathode and the microchannel array.

These difficulties are all the more pronounced as the dimension of the X-ray image intensifier tubes is great, whereas the applications envisaged for an X-ray image intensifier tube with a microchannel array (namely an X-ray image intensifier tube with dual proximity focusing) calls for large useful surface areas, typically with a diameter of over 15 cm, or equivalent surface areas in rectangular formats.

SUMMARY OF THE INVENTION

The present invention relates to image intensifier tubes using both a scintillator to convert an ionizing radiation into light radiation or near-visible radiation and a microchannel array to achieve the amplification of electrons. The invention is aimed at providing a solution to the above-mentioned problems related to the use of a microchannel array.

The invention proposes the positioning of the photocathode directly on the input face of the microchannel array. In this way, an answer is provided both to the problems related to the uniformity of the spacing between the photocathode and the microchannel array, and to the problems of electrical insulation between these two elements. The electrical supply is simplified, for the input face of the microchannel array and the photocathode may be at one and the same potential.

This arrangement further enables the elimination of the effects, on the photocathode, generated by the differences in expansion coefficient between the scintillator and its support, and may even make it possible to eliminate this support. The scintillator is then deposited on the microchannel array which has been coated beforehand with a photocathode. This averts the need to provide for a specific support for the scintillator, said support absorbing a part of the X-rays owing to the fact that it is on the incident X-radiation side. The scintillator is not rigid enough to stand without a support, and the microchannel array then advantageously acts as a support. The photocathode may also be deposited on the scintillator, which is then applied against the array, or partly on the scintillator and partly on the array, the coated scintillator being applied against the coated array.

The invention therefore relates to an image intensifier tube comprising a scintillator, a photocathode, a microchannel array, an input face of the microchannel array being at least partially coated with an electrically conductive layer, wherein the photocathode is constituted by at least one layer in contact with the electrically conductive layer.

BRIEF DESCRIPTION OF THE DRAWINGS

The invention will be understood more clearly and other advantages that it provides will appear from the following description, made by way of a non-restrictive example, with reference to the appended drawings of which.

To simplify the figures and make them easier to read, they have not been drawn to scale.

DETAILED DESCRIPTION OF THE INVENTION

Figure 1:
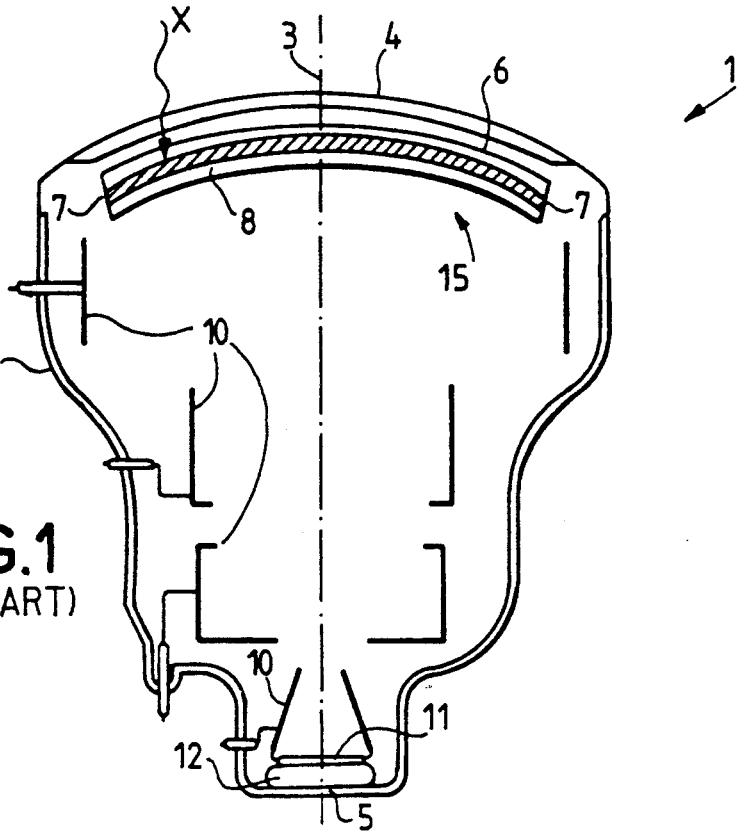
FIG.1 (PRIOR ART)
FIG. 1, already described, shows a prior art X-ray image intensifier tube with an electronic optical system.
Figure 2:
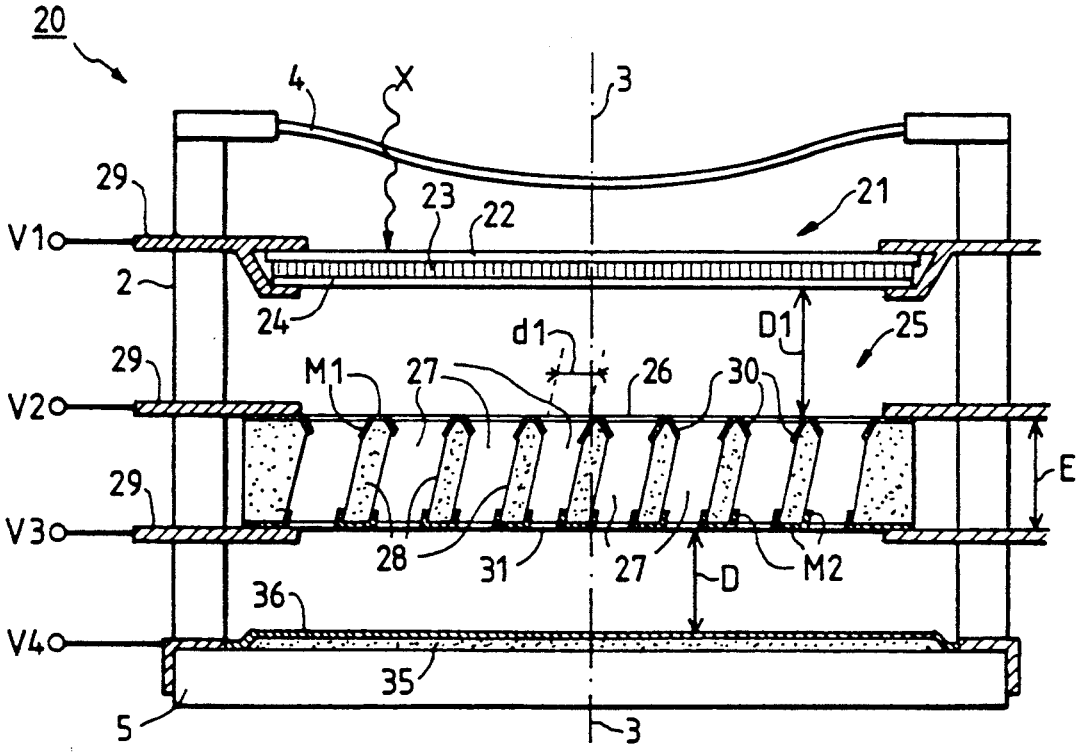
FIG.2 (PRIOR ART)
FIG. 2, already described, shows a schematic sectional view of a prior art X-ray image intensifier tube of the type with a microchannel array.
Figure 3:
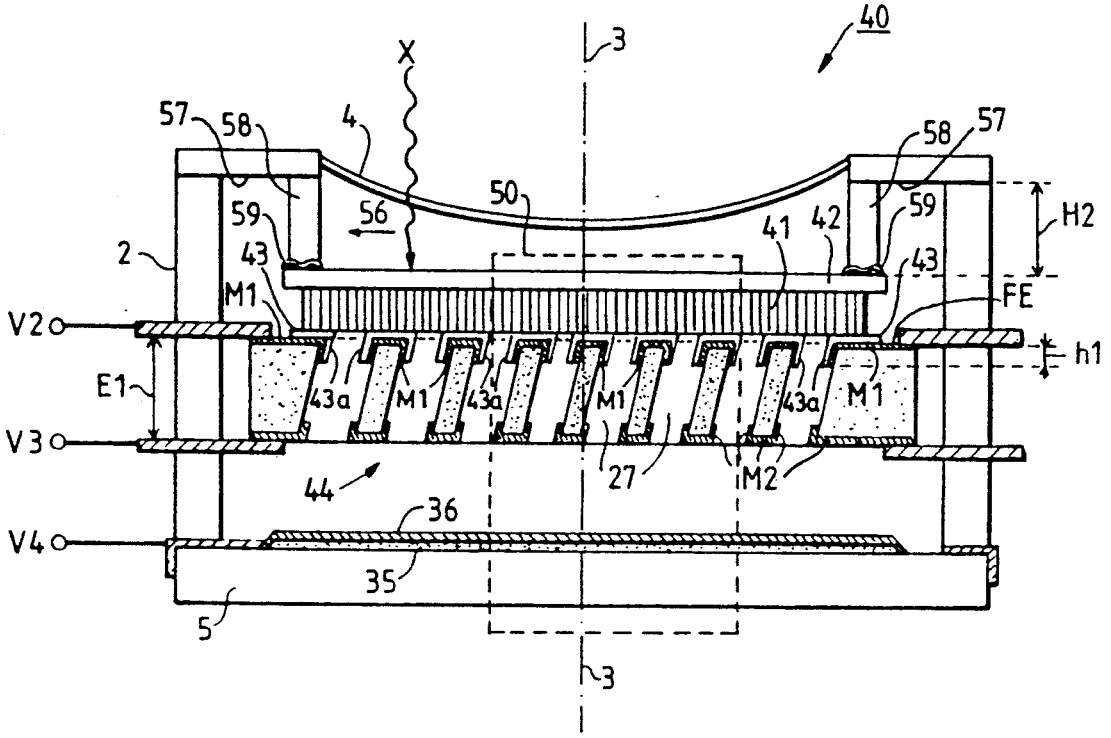
FIG. 3 shows a sectional, schematic view of the structure of an X-ray image intensifier tube of the type with a microchannel array according to the invention.

FIG. 3 shows an image intensifier tube 40 organized according to the invention, for example an X-ray image intensifier tube. The X-ray image intensifier tube 40 has a vacuum-tight chamber, constituted by a tube body 2 closed at one end by an input window 4 and at the other end by an output port 5. This chamber contains a scintillator 41, a scintillator support 42, a photocathode 43, an array 44 of microchannels and a luminescent screen 35, borne by the output port 5, all these elements fulfilling functions similar to those fulfilled by the support 22, the scintillator 23, the photocathode 24, the array 25 and the luminescent screen 35 of the X-ray image intensifier tube shown in FIG. 2.

According to one characteristic of the invention, the photocathode 43 is supported directly on the input face FE of the array 44 (the face oriented towards the input window 4 and towards the scintillator 41). More specifically, in the non-restrictive example shown in FIG. 3, the photocathode 43 is made on a conductive layer, called a first metallization layer M1, formed on the input face FE.

Otherwise, the array 44 of microchannels is formed in a standard way, and it is similar to the array 25 of FIG. 2: a second metallization layer M2 is deposited on the output face FS of the array 44 (the face oriented towards the luminescent screen). This second metallization M2 cooperates with the first metallization layer M1 to set up an electrical field on the length of the microchannels 27 contained in the array 44, i.e. between the input and the output of these microchannels which respectively end at the input face FE and at the output face FS. This electrical field is obtained by the application of the second and third bias potentials V2, V3 to the metallization layers M1, M2 respectively, with the third potential V3 being more positive than the second potential V2. It must be noted that the potential V3 applied to the second metallization layer M1 is further used, as in the prior art, to define an electrical field between the output face FS of the microchannel array and the luminescent screen 35, with a view to an operation, at this level, that is similar to that of the prior art.

To further the setting up of the electrical field in the microchannels 27, the metallizations M1 and M2 are deposited not only on the input and output faces FE, FS but also on the walls of the microchannels 27, at the entrance to and exit from these walls, into which they thus penetrate slightly by a depth h1. To this effect, the method of deposition of the metallized layers M1, M2 uses techniques of evaporation in glancing incidence as already explained in the preamble.

This slight penetration of the first metallized layer M1 into a part of each microchannel 27, a part that constitutes the entrance to each microchannel, is taken advantage of in the invention where it constitutes the support of the photocathode 43 according to the invention. The layer forming the photocathode 43 is thus made on the input face FE as well as at the entrance to each of the microchannels 27, where it constitutes a microphotocathode 43*a*. Consequently, the photocathode 43 comprises as many microphotocathodes 43*a* as there are microchannels 27.

The scintillator 41 is positioned above the photocathode 43 and, in the non-restrictive example described, it directly leans on the input face FE of the array 44, i.e. directly in contact with the photocathode 43.

The scintillator 41 can be fixedly joined, in a standard way, to a support 42 as in the non-restrictive example shown in FIG. 3, and the assembly formed by the scintillator and its support can be fixed to the array 44 of microchannels, for example under the thrusting force of one or more thrusting elements 56. The thrusting elements 56 may be constituted in different ways, notably as a function of the modes of manufacture proper to each X-ray image intensifier tube.

In the non-restrictive example of the invention, the pressure devices 56 rest on an internal peripheral part 57 of the input window 4, this peripheral part being more massive than the central part which, for its part, must absorb the incident X-radiation to the least possible extent. In the example shown in FIG. 2, these thrusting elements 56 comprise: a rigid spacer 58 and a spring washer 59: the spring washer 59 is placed on the support 42 (in a peripheral zone of this support 42) and the spacer 58 is placed between the input window 4 and the spring washer 59. The spacers 58 have a height H2 that is suited to keeping the scintillator 41 and its support 42 applied against the input face of the array 44, by means of the spring washers 59. Several thrustor elements such as these may be used, distributed about the periphery of the scintillators 41.

With a view, firstly, to improving the fixing of the scintillator/support assembly 41,42 and, secondly, to limiting or even cancelling the mechanical deformations resulting from the differences between the expansion coefficients of the scintillator and of the support, it is possible (but not obligatory) to give this scintillator/-support assembly 41,42, before it is fixed to the array 44, a shape (not shown) that is slightly concave (when seen from the input window). With a shape such as this, when the scintillator/support assembly 41,42 is place above the array 44, it is first of all by its central part that it is in contact with the input face FE on which the photocathode 43 is formed. By then ensuring that regular pressure is applied on the periphery of the scintillator/support assembly 41,42 during its fastening by means of the thrusting elements 56, a condition is obtained wherein, by bringing its elasticity into play, this assembly is uniformly supported on the input face FE.

A concave shape such as this, for the assembly formed by the scintillator 41 and its support 42, may result from an internal mechanical tension which may itself result from a concave shape initially given to the support 42 before the deposition of the scintillator 41 on this support. The coefficient of expansion of caesium iodide is generally higher than that of the support, and this scintillator is deposited hot on this support. As a result, the tension exerted by the scintillator 41 tends to reduce the initial concavity, and the support 32 should be given a concavity slightly greater than the one that is finally necessary. It is possible, for example, to give an initial deflection that is close to one millimeter for a support 5 made of an aluminium alloy with a 0.5 millimeter thickness and a diameter of 15 to 25 centimeter.

However, in this configuration where the scintillator 41 is applied to the input face FE of the array, the presence of a scintillator support 42 is not obligatory. Indeed, it is known that a radiation converter or scintillator for an X-ray image intensifier tube can be made on a temporary support which can be eliminated after the making of the scintillator. A technique such as this is described in a French patent filed on behalf of THOMSON-CSF and published under No. 2 530 367. This patent method to make a scintillator screen out of caesium iodide with a needle structure (this type of scintillator is the one most commonly used in X-ray image intensifier tubes) on a temporary support which is then separated from the scintillator. In a case such as this, the scintillator 41 (which has no support) can be fixed to the input face FE of the array 44 through the use, for example, of the thrusting elements 56, as explained here above. However, in the case of a scintillator 41 that has been rid of its support or substrate, the problems of difference in expansions coefficients no longer arise, and it is therefore less necessary to give the scintillator 41 a concave shape (before it is fixed).

With the invention, the photocathode 43 being made on the input face FE of the array of microchannels, an answer is provided to the problems raised in the prior art by the deformations of the primary screen, and generally speaking to the problem of the positioning of the photocathode with respect to the array of microchannels.

The invention further provides a simplification to the electrical supply for the X-ray image intensifier tube 40 as compared with the prior art, i.e. as compared with the supply for the X-ray image intensifier tube of FIG. 2. Indeed, with the X-ray image intensifier tube of the invention, the photocathode 43, being in contact with the first metallization layer M1, is taken to the same second bias potential V2 as the input face FE, and the electrons that it sends out are immediately placed under the influence of the electrical field that prevails in each of the microchannels 27.

Under these conditions, as compared with the standard X-ray image intensifier of FIG. 2, the potentials needed for the operation of the X-ray image intensifier of the invention are limited to:

a second bias potential V2 that simultaneously supplies the input face FE and the photocathode 43;

a third bias potential V3 (more positive than the second potential V2) applied to the output face FS;

and a fourth bias potential V4 (that is more positive than the third potential V3) applied to the luminescent screen 35.

It can be seen that, as compared with the standard X-ray image intensifier tube of FIG. 2, the first bias potential V1 is eliminated; said first potential V1 is used, in the prior art, to set up an electrical field between the photocathode and the input face of the microchannel array.

It must be noted, in addition, that with the X-ray image intensifier according to the invention, this leads not only a reduction in the number of bias potentials but also to making a major reduction in the potential difference applied to this tube.

Figure 4:
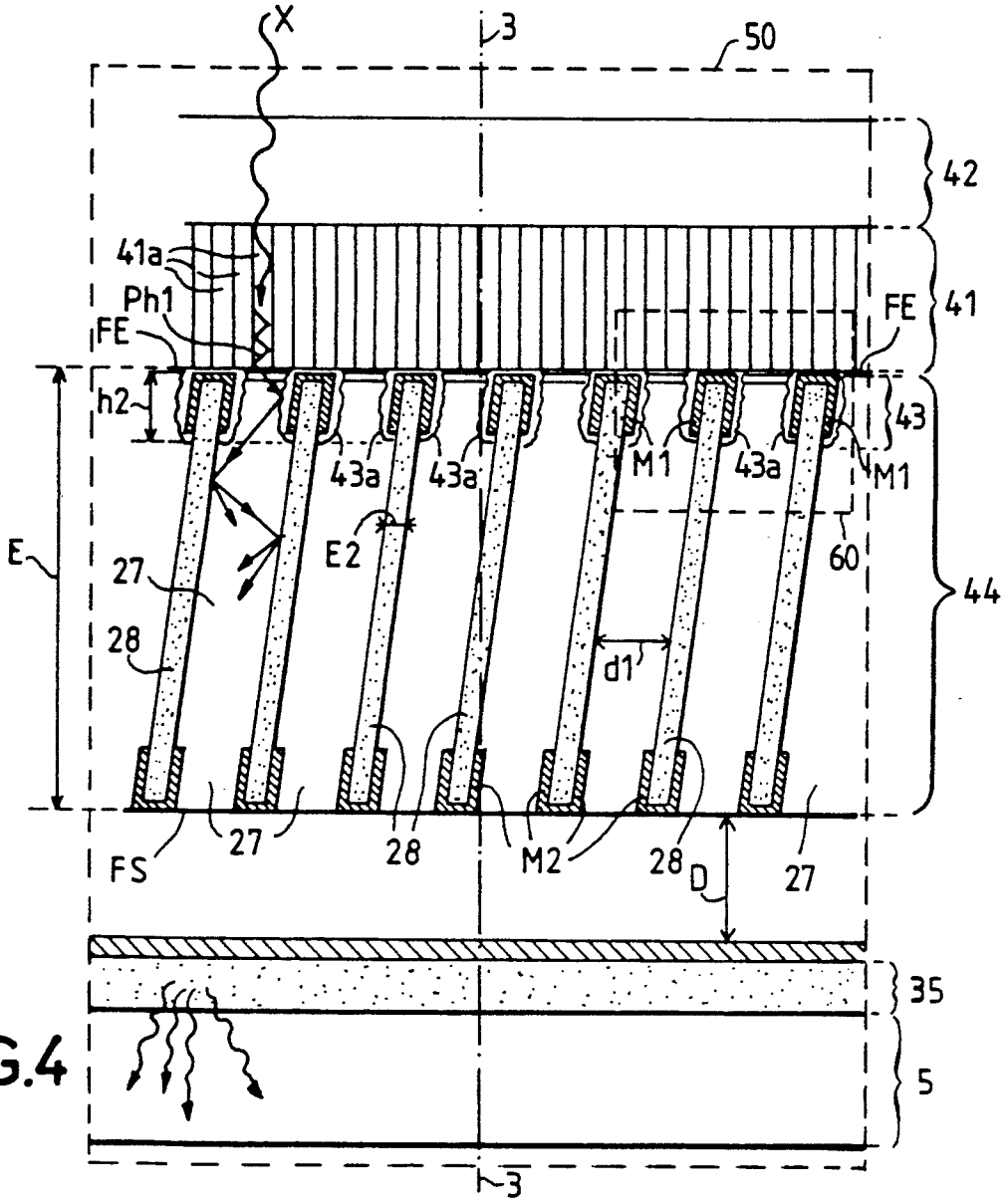
FIG. 4 is an enlarged view of a part of a microchannel array shown in FIG. 3.

FIG. 4 shows an enlarged view of the elements contained in a box 50 of FIG. 3, enabling a clearer illustration of the X-ray image intensifier of the invention. FIG. 4 shows a partial view of the scintillator 41 and its support 42, the array 44 of microchannels and the photocathode 43 located between the array 44 and the scintillator 41, and the luminescent screen 35 located opposite the scintillator 41 in relation to the array 44.

The scintillator 41 is constituted, for example, by a uniform layer of caesium iodide formed by needles 41*a* by growth by evaporation on the support 42, according to a classical method. However, as already explained further above, the support 41 no longer plays the mechanical role that it fulfils in the prior art; it can therefore be eliminated if the scintillator is made on a temporary support. This thickness E1 of scintillator is typically 0.5 millimeter.

The scintillator 41 is positioned in contact with the photocathode 43, which is itself made on the input face FE of the array 44 of microchannels.

The array 44 of microchannels comprises the parallel microchannels 27, separated by partition walls 28. The microchannels 27 are slightly inclined with respect to the normal to the plane of the array, i.e. with respect to the longitudinal axis 3 of the tube. The input face FE comprises the first metallization layer M1, to which the second bias potential V2 is applied. The output face FS comprises the second metallization layer M2 to which there is applied the third potential V3. By way of an indication, a array 44 having a thickness E of the order of 2 millimeters, and microchannels 27 with a diameter d1 of about 50 micrometers, is appropriate for this application.

The luminescent screen 35 is located at a distance D of the order of 1 millimeter from the output face FS of the array 44. The luminescent screen 35 receives the third bias potential V3, by which it is carried to a positive potential of some thousands of volts with respect to the output face FS of the array.

The layer forming the photocathode 43 is deposited by vacuum evaporation on the input face FE, i.e. on the first metallization layer M1, and especially on the entrance to the microchannels to therein constitute the microphotocathodes 43*a*. As in the case of the metallizations M1, M2, this can be done by a technique of slantwise evaporation, i.e. in a glancing incidence, as already explained (the array 44 of microchannels being, for example, on a rotating support). This technique can be used to evaporate the microphotocathodes 43*a* in the microchannels 27 up to a depth h2 corresponding to about twice the diameter d1 of the microchannels, giving about 100 micrometers for microchannels with a diameter of 50 micrometers. The photocathode 43 covers the first metallization M1 and may even go beyond it, towards the interior of the microchannels 27.

When an X-photon is absorbed in the scintillator 41, it gives rise to the emission of several thousands of visible photons. This light, channelled by the needles 41*a* of the scintillator, is sent towards the entrance to of the microchannels 27 (as illustrated in FIG. 4 by a light photon Ph1) where it has a high probability of exciting the photocathode 43 (the effective part of which is probably constituted by the microphotocathodes 43*a*). Electrons sent out by the photocathode, consequently, are attracted towards the interior of the microchannels 27 by the electrical field, where they get multiplied by secondary emission in cascade, following impacts on the walls of the microchannels, according to the well known process that takes place with a microchannel array. At the exit from the microchannels 27, the electrons are accelerated towards the luminescent screen 35 where, by cathodoluminescence, they restitute a visible image which is homologous to the X-ray image absorbed by the scintillator 41.

It must be noted that the visible photons emitted in the scintillator 41 are channelled in this scintillator 41 either towards the array 44 (as illustrated by the photon Ph1) or in the opposite direction, i.e. towards the support 42. If the support 42 is reflective, the photons will all be sent back towards the array 44, which improves the sensitivity to the detriment of the contrast. If the support 42 chosen is absorbent, or if there is no support, then the sensitivity of the X-ray image intensifier tube will be reduced, to the benefit of improved resolution and contrast. The choice will be made according to the applications envisaged.

A portion of the visible photons emitted in the scintillator 41 towards the array 44 is lost: these lost photons (not shown) are partly those that are directed towards the partitions 28 and that do not penetrate the microchannels 27. The other lost visible photons are those that are sent out towards the axis of the microchannels 27 and that thereafter do not encounter the photocathode 43 or more specifically the microcathodes 43*a*.

Figure 5:
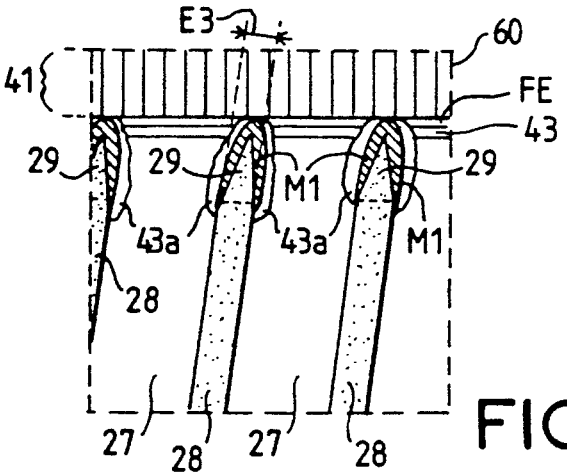
FIG. 5 more particularly shows the input of microchannels shown in FIGS. 3 and 4.

In either case, the proportion of photons lost can be reduced by widening the entrance to the microchannels 27, as is explained in greater detail in a subsequent part of the description made with reference to FIG. 5.

In all, the fraction of the useful photons may exceed 20% of the light photons emitted: this is highly sufficient, given the electron gain provided by the array 44 of microchannels itself. The number of electrons liberated from the photocathode 43, for each X-photon absorbed in the scintillator 41, remains greater than some tens, which is sufficient to contribute only a negligible noise to the detected image.

FIG. 5 shows a particular view of the entrances to two microchannels 27 contained in a box 60 in FIG. 4, in order to illustrate the widened shape that can be given to the microchannels and the shape, resulting therefrom, of the microphotocathodes 43*a*.

The widening of the entry to the microchannels 27 (in the vicinity of the input face FE) may be obtained in a manner that is standard per se, for example by means of an appropriate selective chemical corrosion or chemical etching method performed before the deposition of the first metallization layer M1.

The effect of this chemical etching is to remove material from the walls of the microchannels (in the vicinity of the input surface) and hence, at this level, to reduce the thickness E3 of the partition walls 28, the result of which is the widening. The first metallization M1 and then the layer forming the photocathode 43 are then deposited, as indicated here above. Thus, the surface area of photocathode deposited on the surface is diminished, to the benefit of the microphotocathodes 43*a* formed at the entrance to the microchannels, and hence the effective part of the photocathode 43 is increased.

To obtain a widening of the input of the microchannels 27, it is also possible to extend the end (symbolized in FIG. 5 by a boundary shown in dashes) of the partition walls 28, by an additional deposition 20 with a decreasing thickness E3, obtained by a technique of vapor phase deposition. This additional deposit 29 may be preferably made of a material with an expansion coefficient close to that of the array 44. This material may be silica for example if the array is made of glass. This additional deposit or extension is then covered with the first metallization layer M1 and then with the photocathode 43.

The description of the image intensifier tube of the invention has been made with reference to an image intensifier tube, but the invention can be applied to all image intensifier tubes using a scintillator screen to convert the incident radiation into a visible or near-visible radiation.

The making of an intensifier tube according to the invention can be done by means of techniques that are all well known to specialists.

It must be specified, however, purely by way of an indication, that an image intensifier tube according to the invention should be made, in practice, by a method of transfer under vacuum. Indeed, the photocathode 43 should be evaporated under vacuum on a substrate (on the microchannel array in the case of the invention), and to this end, there should be the necessary cleared space.

The tube of the invention can be introduced into a vacuum transfer frame (not shown) in the form of three sub-assemblies:

the first sub-assembly comprises the body of the tube, the microchannel array, the luminescent screen, the output port (the luminescent screen being, for example, deposited directly on the internal face of the port), all these elements being fixed in a definitive way;

the second sub-assembly is constituted by the scintillator on its support (or on a temporary support);

the third sub-assembly is constituted by the input window, provided for example with a flange (not shown) that can get closed on the body of the tube.

Inside the frame, under vacuum, the different parts will be degassed as usual, then the photocathode will be deposited at the input of the array by a slantwise evaporation, for example by using sources of antimony and alkaline metals (K, Cs) positioned on the sides. The evaporation of the photocathode will be controlled according to the known method.

Once the photocathode has been made, a system of handling arms working under vacuum enables the deposition on and fixing of the scintillator to the array, and then makes it possible to position and seal the input window on the body of the tube in a vacuum-tight manner.

The tube will then be replaced in ambient air, ready for use.

Figure 6:
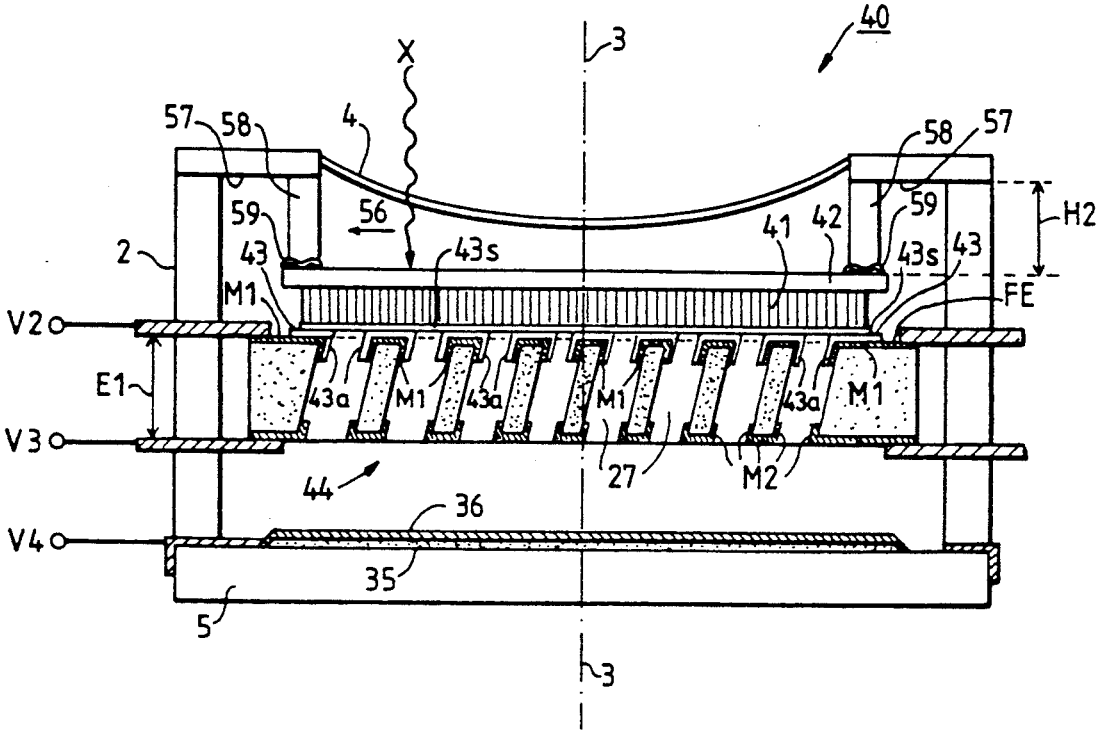
FIG. 6 is a view similar to that of FIG. 3, and illustrates the presence of a photocathode layer made on a scintillator.

FIG. 6 illustrates an embodiment in which the photocathode 43 is constituted not only by a layer deposited on the input face FE of the array 44, but also by a second layer 43*s* deposited on a face of the scintillator 41 oriented towards the array 44. Otherwise, FIG. 6 is similar to FIG. 3.

Since the scintillator 41 is applied to the input face FE, the second layer 43*s* is in contact with the first photoemissive layer 43, and is thus biased at the same potential as this layer 43.

It must be noted that it is thus possible, in the spirit of the invention, for the cathode to be constituted by single layer 43*s* deposited on the scintillator 41; in such a case, the layer 43*s* deposited on the scintillator 41 would be in direct contact with the first metallization M1.

The second photoemissive layer 43*s* can be used to improve the electron yield, at the cost of greater manufacturing complexity. However, it is perfectly possible to overcome the difficulties entailed by this complexity.

Indeed, the making of the photocathode 43 on the input face FE of the array of microchannels, before the scintillator 41 is attached to this input face and before it is held in position as described here above, and also the vacuum-tight sealing of the input window 4, necessitates equipment that is complicated (albeit known per se) enabling the handling, under vacuum, of the various parts of the tube (body of the tube fitted out with the output screen and with the array, primary screen or scintillator, input window). In this same equipment under vacuum, it is necessary to have available sources of evaporation of the materials constituting the photocathode (antimony and alkaline metals) and possibilities of relative motion (planet wheels), or multiple sources, enabling the uniform evaporation of the photocathode on the input face of the array.

In this relatively complex system, it is possible to arrange the scintillator 41, during the making of the photocathode 43, in a position symmetrical with that of the array 44, with respect to the evaporation sources, in such a way that a photocathode will be made simultaneously on the input face of the array and on the chosen face of the scintillator 41.

What is claimed is:

1. An X-ray image intensifier tube comprising:

a scintillator screen for converting incoming X-ray radiation into radiation having lower energy than said incoming X-ray radiation;

a photocathode comprising at least one photoemissive layer; and a microchannel array comprising partition walls which define microchannels and having an input face oriented to receive radiation output from said scintillator screen, wherein said input face is at least partially coated with a metallization layer which contacts said at least one photoemissive layer of said photocathode and wherein said scintillator screen is disposed on said input face of said microchannel array.

2. An X-ray image intensifier tube according to claim 1, wherein said at least one photoemissive layer of said photocathode is deposited on said input face of said microchannel array.

3. An X-ray image intensifier tube according to claim 2, wherein said at least one photoemissive layer of said photocathode is formed on said partition walls defining said microchannels such that said at least one photoemissive layer extends into each microchannel defined by said partition walls.

4. An X-ray image intensifier tube according to claim 2, wherein said at least one photoemissive layer of said photocathode is deposited on said scintillator screen.

5. An X-ray image intensifier tube according to claim 1, wherein said at least one photoemissive layer of said photocathode which contacts said metallization layer is deposited on said scintillator screen.

6. An X-ray image intensifier tube according to any of claims 1–5, wherein ends of said partition walls that define each of said microchannels are tapered at said input face so as to provide a widened entrance to each of said microchannels.

7. An X-ray image intensifier tube according to claim 6, wherein ends of said partition walls at said input face are coated with an additional deposit, the thickness of which varies, in order to obtain a widened entrance to each of said microchannels.

8. An X-ray image intensifier tube according to any of claims 1–5, wherein said microchannel array constitutes the sole support of said scintillator screen.

* * * * *